US006109999A

United States Patent [19]

Kuo

[11] Patent Number: 6,109,999

[45] Date of Patent: Aug. 29, 2000

[54] COMBINATION TOY HOOP

[76] Inventor: Shun-Lung Kuo, No. 53, Chung-Cheng St., Chung-Cheng Tsun, Hsinshe Hsiang, Taichung, Taiwan

[21] Appl. No.: 09/324,502

[22] Filed: Jun. 3, 1999

[51] Int. Cl.[7] ..... A63H 33/00

[52] U.S. Cl. ..... 446/236; 601/118; 601/132

[58] Field of Search ..... 446/26, 28, 85, 446/102, 107, 119, 236; D11/3, 11; 601/118, 132

[56] References Cited

U.S. PATENT DOCUMENTS

| | | | |
|---|---|---|---|
| D. 359,996 | 7/1995 | Barzani | D21/108 |
| 1,702,991 | 2/1929 | Bechmann . | |
| 2,714,269 | 8/1955 | Charles . | |
| 2,990,640 | 7/1961 | Burnbaum | 446/102 |
| 3,458,949 | 8/1969 | Young . | |
| 3,747,261 | 7/1973 | Salem . | |
| 3,822,499 | 7/1974 | De Vos . | |
| 5,492,526 | 2/1996 | Chen | 601/132 |
| 5,531,665 | 7/1996 | Chen | 601/118 |
| 5,667,326 | 9/1997 | McGaffigan | 446/119 |

FOREIGN PATENT DOCUMENTS

| | | | |
|---|---|---|---|
| 1159942 | 2/1958 | France | 446/85 |

*Primary Examiner*—Robert A. Hafer
*Assistant Examiner*—Jeffrey D. Carlson
*Attorney, Agent, or Firm*—Rosenberg, Klein & Lee

[57] ABSTRACT

A combination toy hoop, which includes a plurality of spherical members, and a plurality of flexible coupling rods respectively connected between each two of the spherical members, the spherical members each are formed of two hemispherical shells fastened together by a plug joint or screw means, the hemispherical shells of each of the spherical members each having two keyway-like coupling notches, the coupling rods each having two round heads at two opposite ends respectively engaged into the keyway-like coupling notches at the hemispherical shells of the spherical member.

2 Claims, 5 Drawing Sheets

COMBINATION TOY HOOP

BACKGROUND OF THE INVENTION

The present invention relates to a toy hoop, and more particularly to a combination toy hoop which is comprised of a plurality of spherical members, and a plurality of flexible coupling rods respectively and detachably connected between each two of the spherical members.

Regular toy hoops are commonly made of plastics by blowing. There is also known a combination toy hoop which is comprised of arched elements. The arched elements each have a pin hole at one end, and a pin at an opposite end. By plugging the pin at one arched element into the pin hole at another, the arched elements are connected to one another, forming a hoop. When set up, the shape of the hoop is fixed. Because conventional toy hoops are not deformable, they produce little massaging effect to the player's body due to a limited contact area. Another drawback of conventional toy hoops is that they produce less exercising effect because give less pressure to the player's body when rotated. If to achieve a better exercising effect, the size and weight of the toy hoop must be relatively increased. Furthermore, these conventional toy hoops cannot be adjusted to fit different users, or different parts of the body.

SUMMARY OF THE INVENTION

The present invention provides a toy hoop which eliminates the aforesaid problems. According to one aspect of the present invention, the toy hoop is comprised of a plurality of spherical members, and a plurality of flexible coupling rods respectively connected between each two of the spherical members. Because the toy hoop is formed by using flexible coupling rods to connect spherical members into a loop, the size of the toy hoop can be set as desired. According to another aspect of the present invention, the spherical members each are formed of two hemispherical shells fastened together by a plug joint or screw means. According to still another aspect of the present invention, the hemispherical shells of each of the spherical members each have two keyway-like coupling notches, and the coupling rods each have two round heads at two opposite ends respectively engaged into the keyway-like coupling notches at the hemispherical shells of the spherical member. According to still another aspect of the present invention, the spherical members each have massaging ribs at the outside wall, which massage the user's body upon rotary motion of the toy hoop around a part of the player's body.

DETAILED DESCRIPTION OF THE PREFERRED EMBODIMENT

Figure 1:
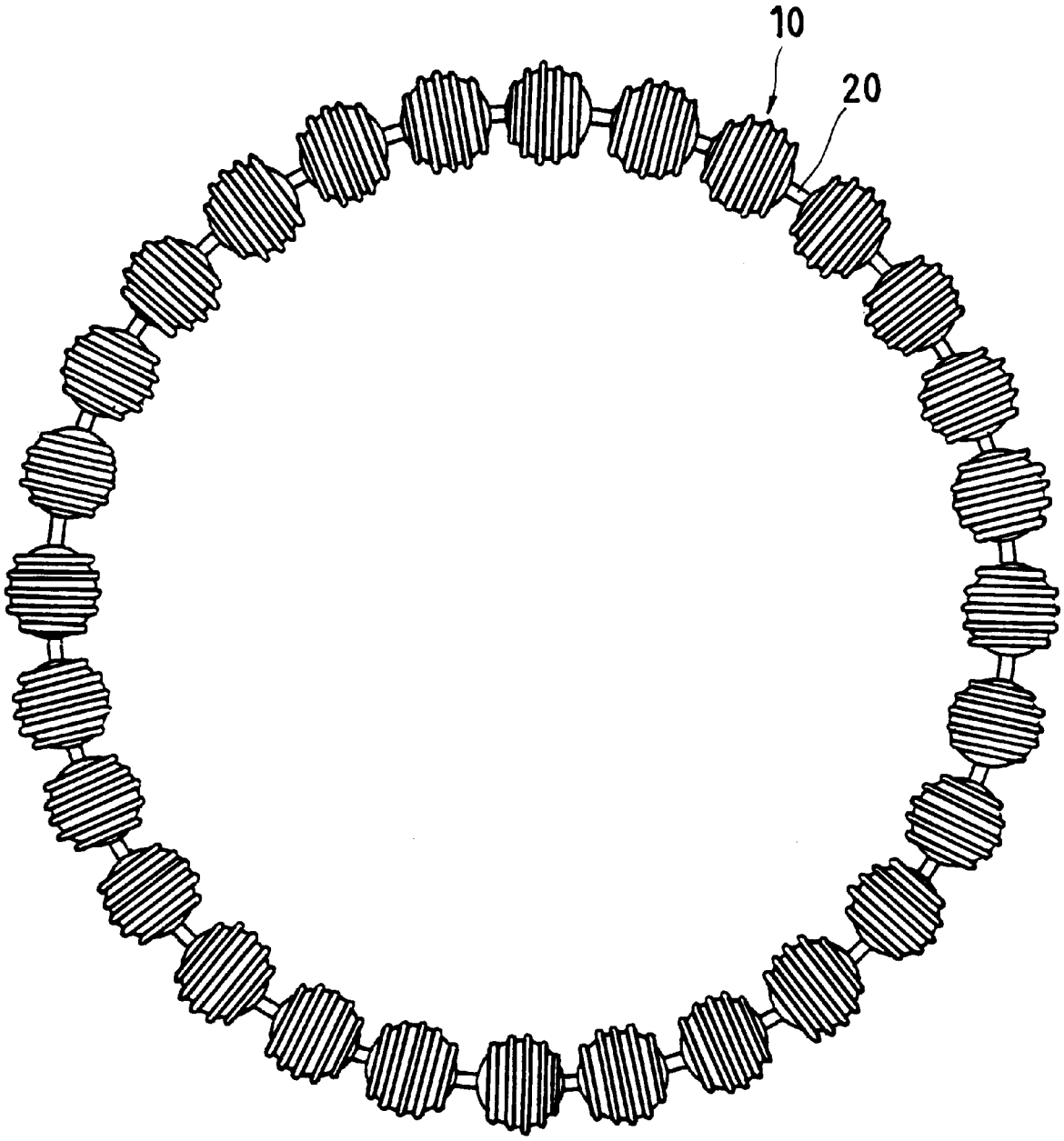
FIG. 1 is a plain view of a combination toy hoop according to the present invention.
Figure 2:
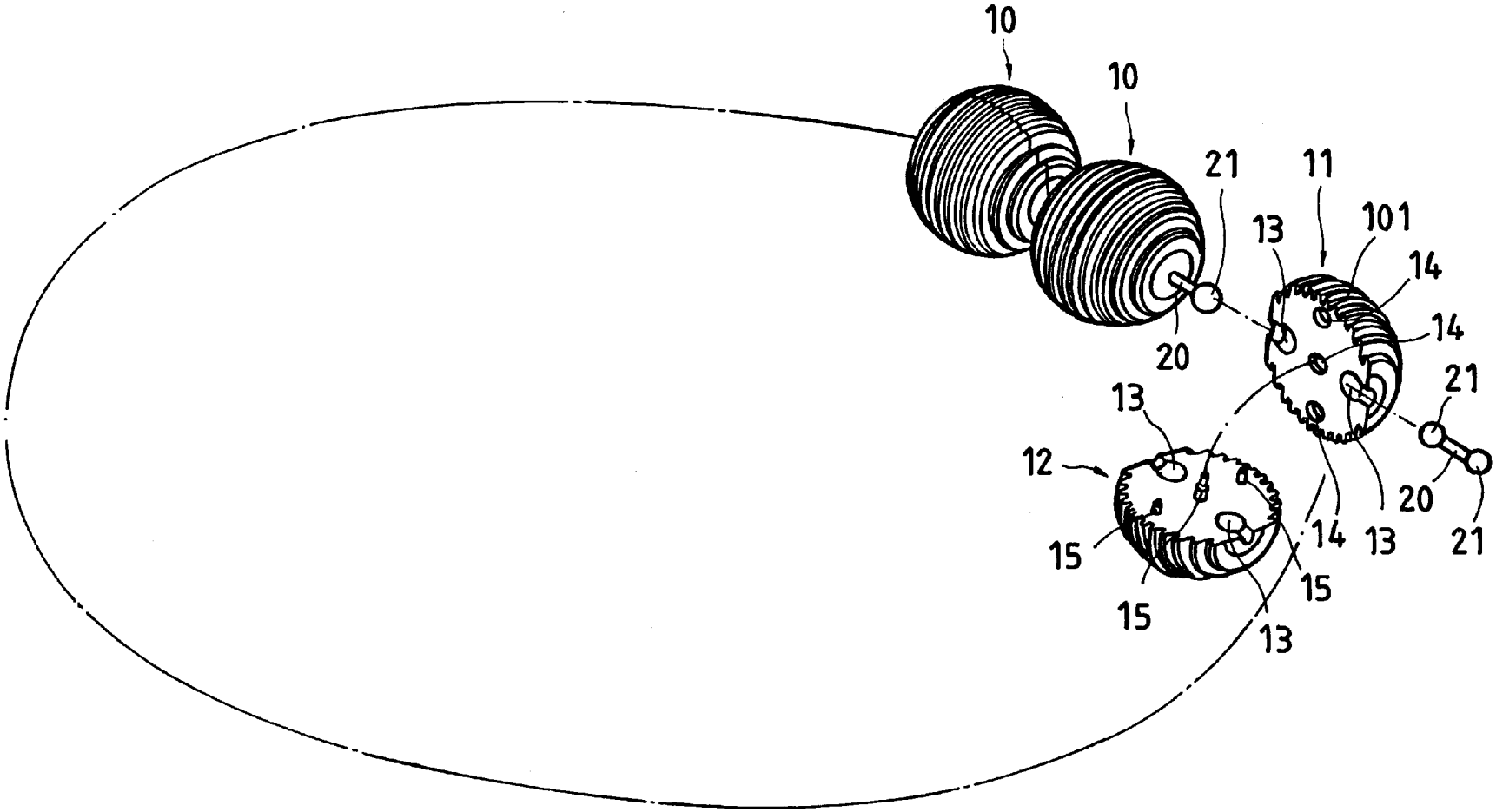
FIG. 2 is an exploded view of a part of the present invention.
Figure 3:
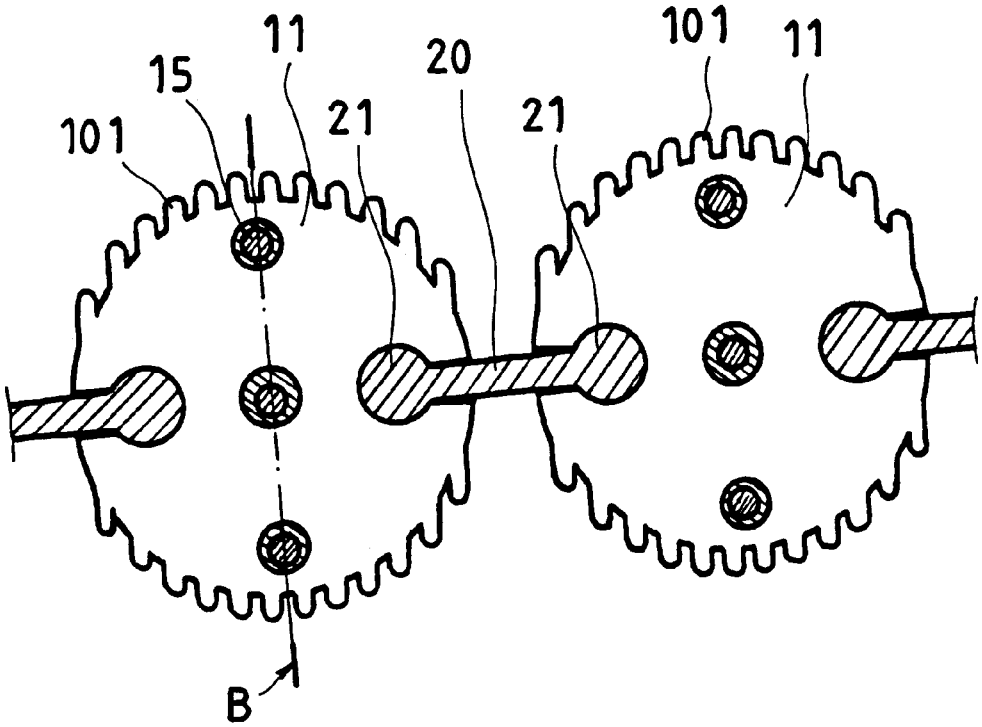
FIG. 3 is a sectional view of a part of the present invention, showing the connection between coupling rods and spherical members.
Figure 4:
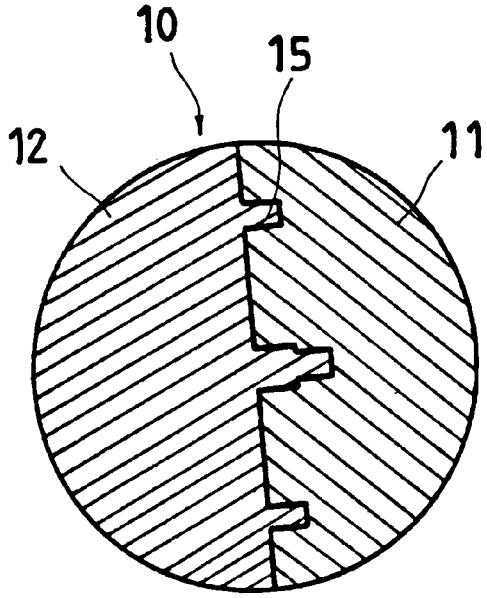
FIG. 4 is a sectional view of a spherical member according to the present invention.

Referring to FIGS. from 1 through 4, a combination toy hoop in accordance with the present invention is shown comprised of a plurality of spherical members 10, and a plurality of coupling rods 20 respectively connected between each two spherical elements 10. Each spherical member 10 is comprised of two symmetrical hemispherical shells, namely, the first hemispherical shell 11, and a second hemispherical shell 12. The hemispherical shells 11 and 12 each comprise two keyway-like coupling notches 13 aligned at the respective flat abutting face and reversely extended to the periphery, and ribs 101 at the periphery. The first hemispherical shell 11 further comprises a plurality of plug holes 14 at its flat abutting face. The second hemispherical shell 12 further comprises a plurality of plug pins 15 perpendicularly raised from its flat abutting face. The coupling rods 20 are respectively made from elastic material, each having two opposite ends terminating in a respective rounded head 21. By plugging the plug pins 15 at the second hemispherical shell 12 into the plug holes 14 at the first hemispherical shell 11, the hemispherical shells 11 and 12 are fastened together with the respective flat abutting faces abutted against each other. The round heads 21 of the coupling rods 20 are respectively fastened to the keyway-like coupling notches 13 at the hemispherical shells 11 and 12 of the spherical members 10. By inserting one round head 21 of each of the coupling rods 20 respectively to one keyway-like coupling notch 13 at the first (or second) hemispherical shell 11 or 12 of each of the spherical members 10 and then respectively fastening the second (or first) hemispherical shell 12 or 11 of each of the spherical members 10 to the second (or first) hemispherical shell 12 or 11 of each of the spherical members 10, the spherical members 10 and the coupling rods 20 are alternatively connected together, forming a hoop.

Figure 5:
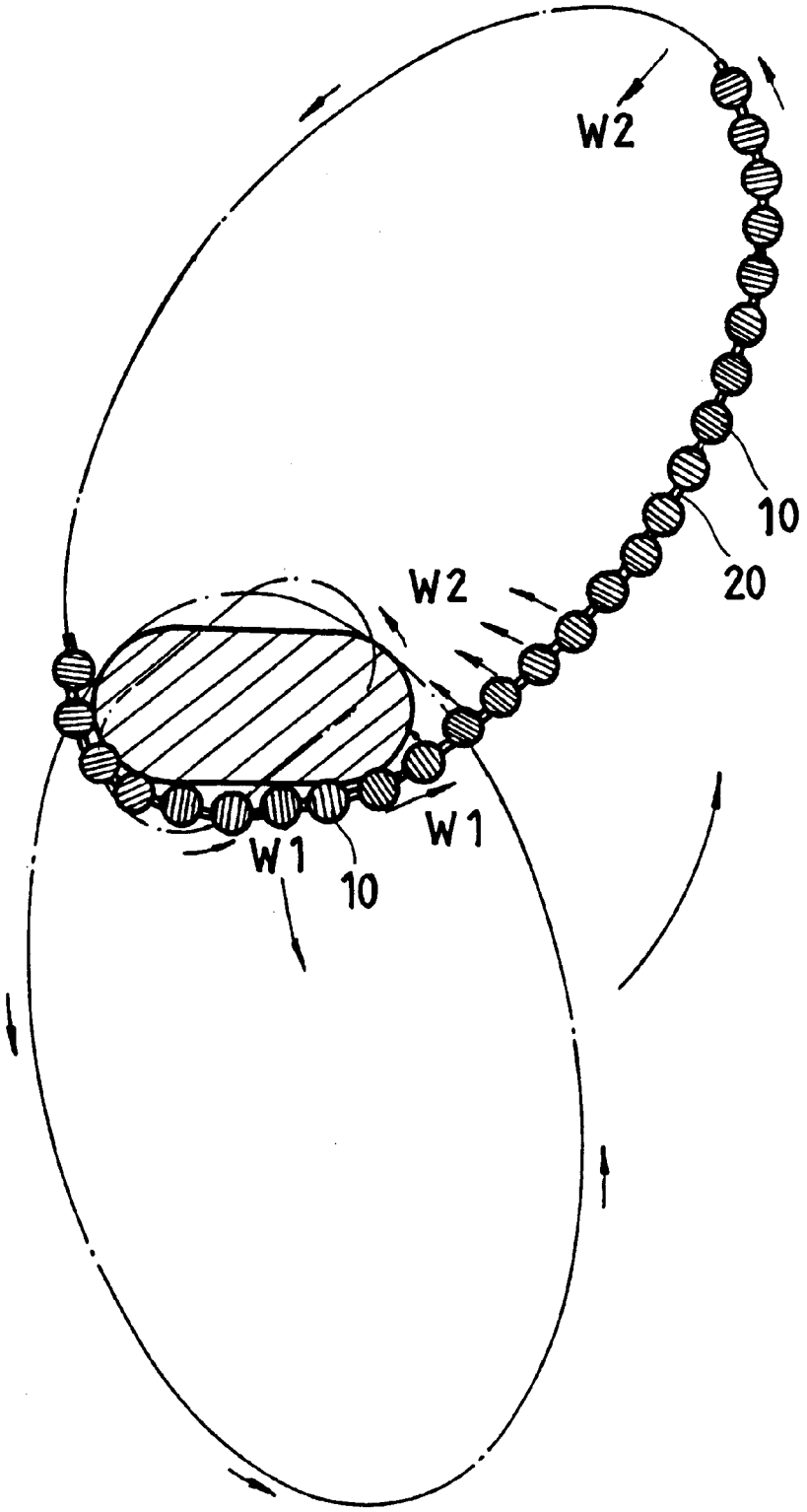
FIG. 5 is an applied view of the present invention.

Referring to FIG. 5, when in use, the toy hoop is hung on the player's neck or body, and then the player rotates the head or twists the body, causing the hoop to be turned about the neck or body. Because the coupling rods 10 are made from elastic material, they are deformable. During motion, the toy hoop changes from a circular shape to an oval shape.

Referring to FIG. 5 again, because the toy hoop is deformable, it fits the peripheral profile of the neck or body when turned with the head or body of the player. During rotary motion of the toy hoop around the player's neck or body, the player's neck or body is massaged by the ribs 101 at the spherical members 10. When the toy hoop is turned about the player's neck or body, a centrifugal force W1 is produced, and at the same time a reactive force W2 is produced toward the player's neck or body, causing the massaging effect to be reinforced.

Figure 6:
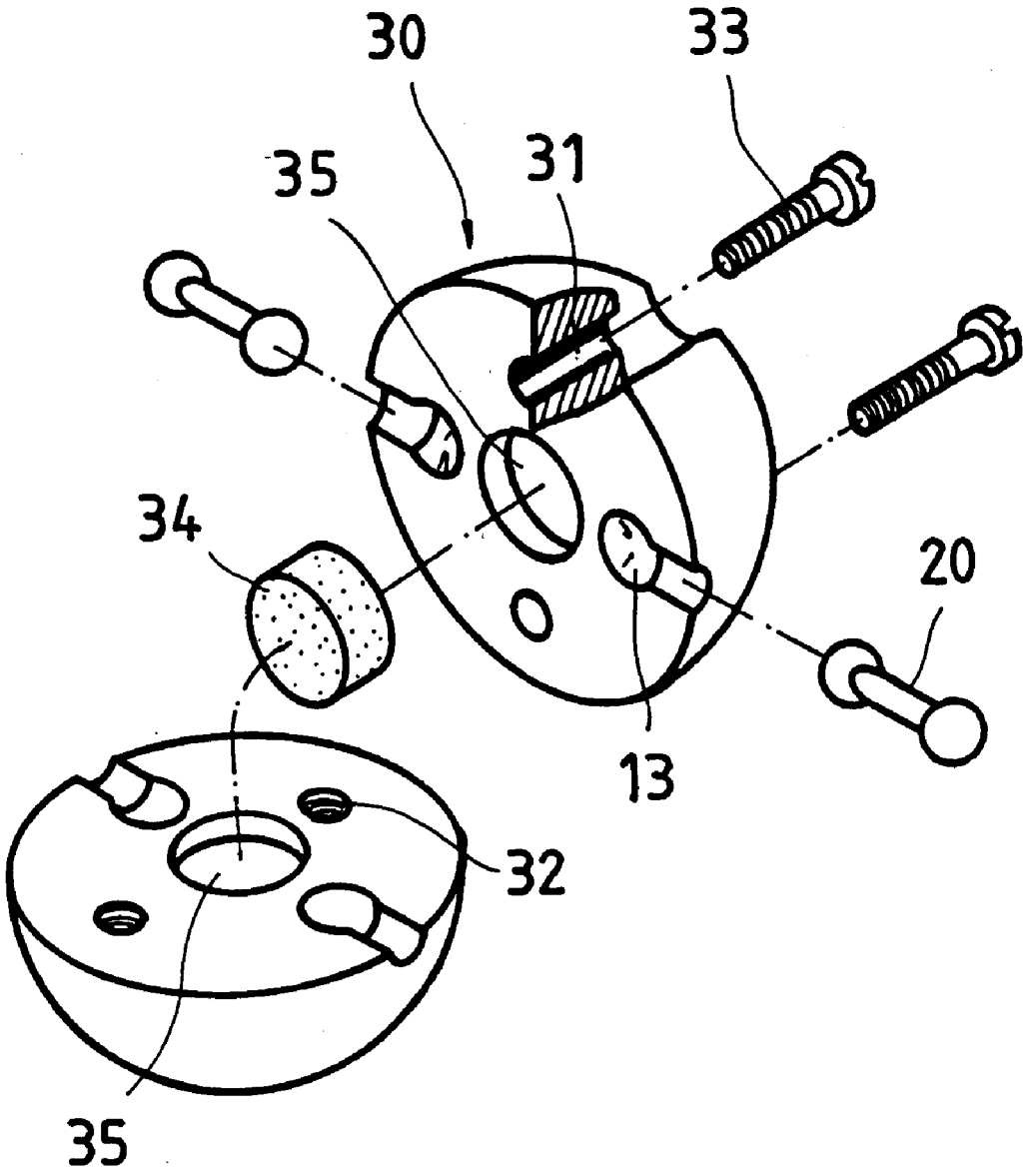
FIG. 6 is an exploded view of a part of an alternate form of the present invention.

FIG. 6 is an exploded view of a part of an alternate form of the present invention. According to this alternate form, the spherical member, referenced by 30, is comprised of two symmetrical hemispherical shells. By inserting respective screws 33 through respective through holes 31 at one hemispherical shell and threading the respective screws 33 into respective screw holes 32 at the other hemispherical shell, the two hemispherical shells are fastened together, forming a spherical member 30. The hemispherical shells of the spherical member 30 each have a recessed center hole. A magnet 34 is installed in the recessed center holes 35 between the hemispherical shells. When a toy hoop of this embodiment is turned about the player's neck or body, the magnet 34 in each spherical member 30 produces a magnetic field to stimulate the player's blood circulation.

It is to be understood that the drawings are designed for purposes of illustration only, and are not intended for use as a definition of the limitations and scope of the invention disclosed.

What the invention claimed is:

1. A combination toy hoop comprising a plurality of spherical members, and a plurality of flexible coupling rods respectively connected between each two of said spherical members, each of said spherical members comprising a first hemispherical shell, a second hemispherical shell, and fastening means securing said first hemispherical shell and said second hemispherical shell together, each of said plurality of spherical members including a magnet mounted between said first and second hemispherical shells, said first hemispherical shell and said second hemispherical shell each having (a) a flat abutting face abutted-against each other, and (b) two keyway-like coupling notches formed therein for respective coupling to said coupling rods, each of said coupling rods having two rounded heads at two opposite ends respectively engaged within said keyway-like coupling notches of said first and second hemispherical shells of respective spherical members.

2. The combination toy hoop as recited in claim 1 where each of said spherical members have a plurality of spaced massaging ribs extending from a circumferential surface portion thereof to massage a user as said spherical members are rotated on the user's body.

* * * * *